United States Patent [19]

Sévigny

[11] Patent Number: 4,855,715

[45] Date of Patent: Aug. 8, 1989

[54] DOOR MOUNTED ALARM ASSEMBLY

[76] Inventor: Albert R. Sévigny, 1600, Robert-Charbonneau #501, Montreal, Qc., Canada, H4N 2Y1

[21] Appl. No.: 121,179

[22] Filed: Nov. 16, 1987

[51] Int. Cl.[4] ..... G08B 13/08; H01H 3/16

[52] U.S. Cl. ..... 340/545; 200/61.76

[58] Field of Search ..... 340/545, 542, 549; 200/61.7, 61.76, 61.77, 61.62, 271–274, 290, 332, 335, 336; 109/41–44

[56] References Cited

U.S. PATENT DOCUMENTS

| | | | |
|---|---|---|---|
| 3,266,029 | 8/1966 | Callahan | 340/545 X |
| 3,704,460 | 11/1972 | Frank | 340/542 |
| 3,714,643 | 1/1973 | Sosin et al. | 340/542 |
| 3,727,210 | 4/1973 | Hawkins | 340/542 |
| 3,768,087 | 10/1973 | Kaye et al. | 340/545 |
| 3,778,806 | 12/1973 | Williams | 340/545 X |
| 3,851,325 | 11/1974 | Maged | 340/542 |
| 3,866,164 | 2/1975 | Peterson | 340/545 X |
| 3,896,316 | 7/1975 | Serrano | 340/545 X |
| 4,350,977 | 9/1982 | Dykes | 340/545 |
| 4,394,584 | 7/1983 | Spahni et al. | 340/549 X |

FOREIGN PATENT DOCUMENTS 976258 10/1975 Canada .

*Primary Examiner*—Glen R. Swann, III
*Assistant Examiner*—Thomas J. Mullen, Jr.
*Attorney, Agent, or Firm*—Roland L. Morneau

[57] ABSTRACT

An alarm system mounted in a casing intended to be installed in a door. The casing includes a power supply, a noise producing device and a circuit for connecting the power supply to the noise producing device. The circuit includes a key operating device and a mechanism responsive to a detecting knob located on the stile of a door. The key operating device comprises a tumbler switch and a cam operated by the switch which is mounted in the circuit. The mechanism responsive to the knob comprises a hingely mounted plate connected to a spring for biassing the plate in the direction of the cam and the switch. The switch can close the circuit when the door opens and the knob projects outside the stile of the door. Additional cams, tumbler switches and circuits may be combined for producing a variety of alarm producing conditions.

6 Claims, 5 Drawing Sheets

DOOR MOUNTED ALARM ASSEMBLY

BACKGROUND OF THE INVENTION

1. Field of the Invention

The present invention is an alarm assembly adapted to be mounted in a door for detecting unwanted intrusion. The assembly is adaptable to doors regardless of whether they are opened from the right or the left-hand side. The present assembly operates separately from the lock of the door.

2. Prior Art

| | |
|---|---|
| U.S. Pat. No. 3,266,029 | U.S. Pat. No. 3,768,087 |
| U.S. Pat. No. 3,704,460 | U.S. Pat. No. 3,851,325 |
| U.S. Pat. No. 3,714,643 | Canadian Pat. No. 976,258 |
| U.S. Pat. No. 3,727,210 | |

The above listed patents were identified as prior art for the present invention. Some of them are directed to alarm system directly integrated to door locks or used in conjunction with locks. U.S. Pat. No. 3,768,087 discloses an alarm system mounted in a door frame. A limit switch push button extends through the door and is actuated by a cantilever spring element.

SUMMARY OF THE INVENTION

The present invention is a self-operating assembly independent of the door lock per se. It is intended to be installed through the door and to project on both the inside and outside of the door. The mechanism is particularly designed to react to a detecting knob slidably mounted through either one of the two lateral faces of a door.

The alarm assembly is mounted in a casing for housing a power supply, a noise producing device, a circuit for connecting the power supply to the noise producing device, a key operating device and a mechanism responsive to the detecting knob. The key operating device comprises a cam for actuating a tumbler switch mounted in the circuit. The mechanism responsive to the knob comprises a hinged plate mounted connected to a spring for biassing the plate in the direction of the cam and the switch. The switch can close the circuit when the door opens and the knob projects outside the lateral face or stile of the door. Additional cams, tumbler switches and circuits may be used for adapting the system to a variety of alarm producing conditions.

DETAILED DESCRIPTION OF THE INVENTION

Figure 1:
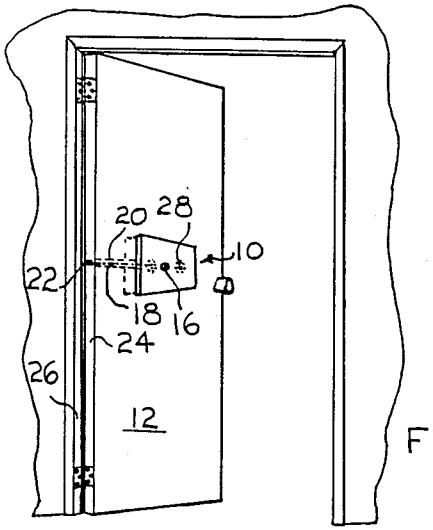
FIG. 1 is a perspective view of an opened door through which is mounted the alarm assembly according to the present invention.
Figure 7:
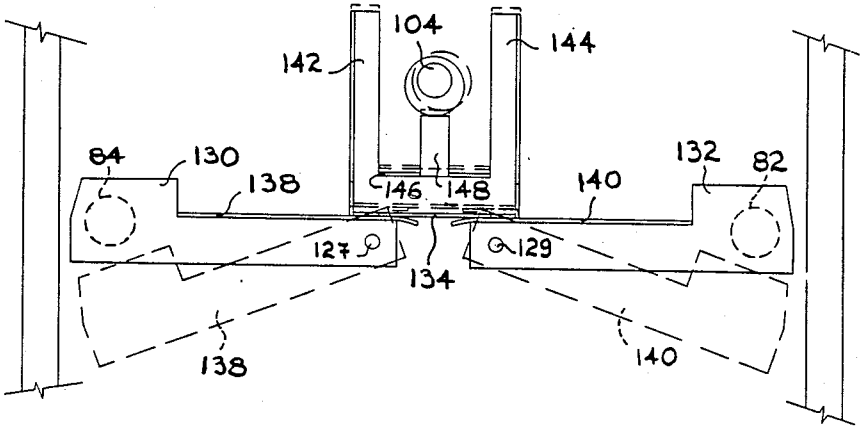
FIG. 7 is a front plan view of the screw head hiding mechanism mounted in the portion of the casing shown in FIG. 3 and, FIG. 8 illustrates an embodiment of an electrical circuit used in the alarm assembly.

The alarm assembly 10 is mounted through a door 12 as shown in FIG. 1. A casing 14 projects on both sides of the door. A key is used to operate a lock 16 connected inside to change the Functions of the alarm assembly. A flexible link 18 extends through a channel 20 in the door 12 between the casing 14 and a spring mounted knob 22 projects outside the door stile 24. When the door 12 is closed, the knob 22 abut against a door jam 26 and receeds inside the door stile 24. The alarm assembly may be key-operated from both sides as explained later. The casing 14 is perforated with a plurality of small holes 28 on its external surface to increase the propagation of the acoustical signal of the alarm. The flexible link 18 which may be a chain is protected by a tightly wound metal coil spring 21 extending inside the channel. Such a coil spring is intended to prevent vandals from trying to saw the link 18.

Figure 2:
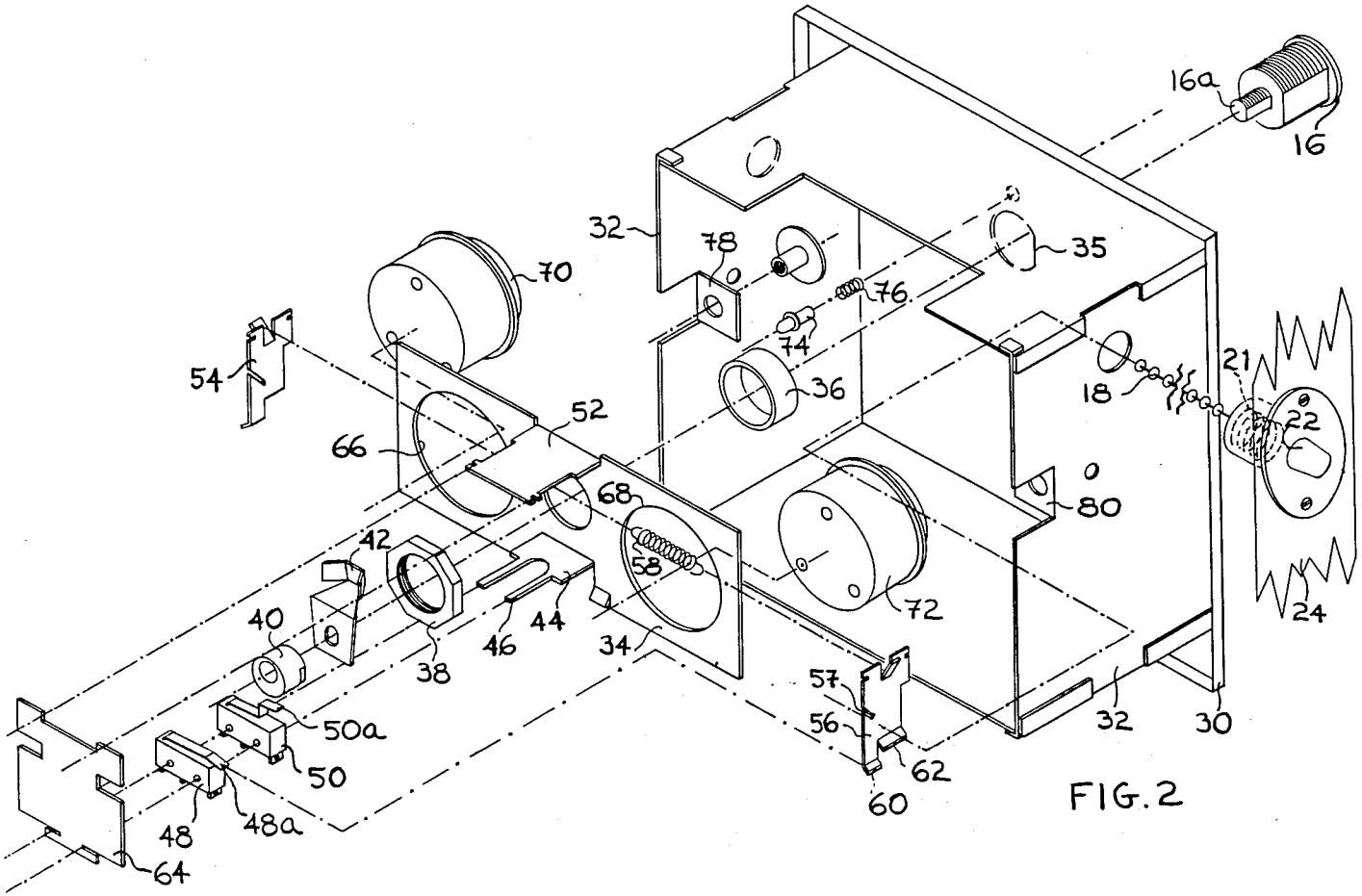
FIG. 2 is an exploded view of the portion of the casing of the alarm assembly projecting on the external surface of the door.

A front panel 30 of the casing 14 appears on the external surface of the door and displays the lock 16. The front panel 30 is connected to four lateral panels 32 extending through a rectangular cut-out in the door. A partition 34 is connected to front panel 30 by means of a spacer 36 and a nut 38 threadedly engaged on the periphery of the lock 16. The lock 16 is roatably fixed in an aperture 35. A cam 40 is mounted on a rotatable spindle **16*a* of the lock 16 which also support the bracket 42. The rotation of the spindle 16*a* causes the rotation of the cam 40 and the bracket 42 when the lock 16 is operated by the key. The partition 34 has a lower flange 44 with two legs 46 projecting under and beyond the cam 40 to support two tumbler switches 48 and 50. The partition 34 has also an upper flange 52 to hingedly support two plates 54 and 56. The plates 54 and 56 are freely suspended from the flange 52 and the lower ends are pulled towards each other by a coil spring 58 hooked to each plate 54 and 56 at the upper end thereof. The lower end of the plates 54 and 56 abuts against lever blades 48*a* and 50*a* of tumbler switches 48 and 50. Only one of the plates 54 and 56 actuates the switches 48 and 50 depending on which side of the door the knob 22 is mounted. In FIG. 2, the plate 56 is the one which is normally pulled by the detecting knob 22 resiliently mounted in the stile 24 of the door. Spring 21 which normally projects knob 22 outside stile 24 when the door is opened is stronger than the spring 58 and pulls on chain 18 and the hinged plate 56 unless the door is closed. The flexible chain 18 connects the knob 22 to a slot 57 in the plate 56. The plate 54 is used if the detecting knob is mounted through the opposite stile of the door, i.e. for a door opening in the other direction. The plate 56 has two angularly pending lips 60 and 62 adapted to override lever blades 48*a* and 50*a* respectively. The operation of these switches will be explained later with the electrical circuit. A cover plate 64 is fixed between the flange 52 and the legs 46 for housing the switches 48 and 50, the cam 40, the bracket 42 and the nut 38**.

The partition 34 is provided with two spaced apertures 66 and 68 for supporting the buzzers 70 and 72.

The bracket 42 mounted on the spindle 16*a* serves to push on a pin 74 which can project partly outside the front panel 30 when the bracket is in its vertical position as shown in FIG. 2. When the bracket 42 is tilted sideways by turning the key in the lock 16, the pin 74, mounted in the panel 30 is pushed inwardly by the spring 76 so as to be flush with the panel 30. The longitudinal position of the pin 74 is used as a palpable indicator for the orientation of the key for a blind person or when the alarm system is in the dark. A battery (not shown) necessary for the operation of the buzzers 70 and 72 is located in the lower part of the casing 14 below the partition 34.

Figure 3:
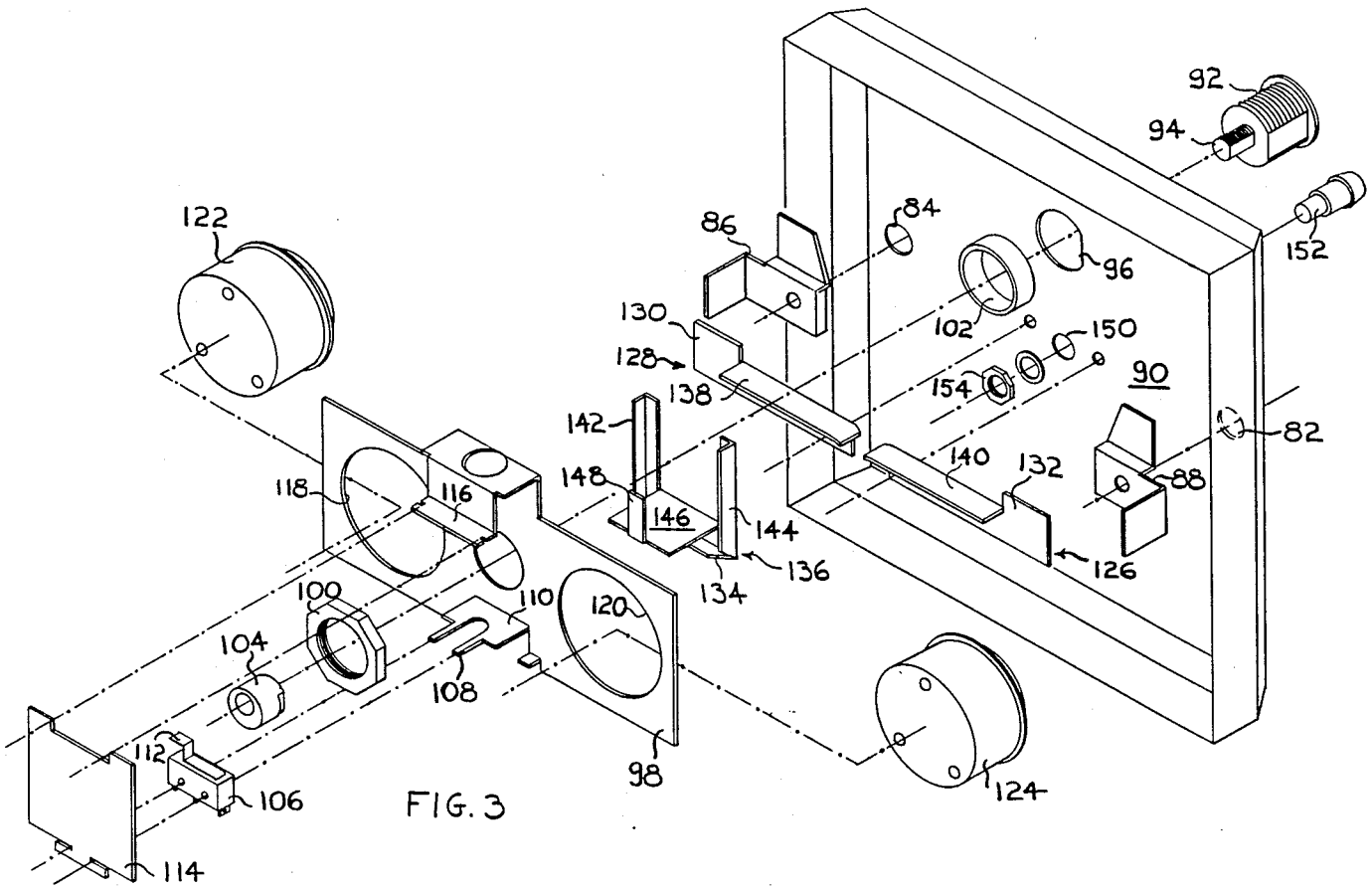
FIG. 3 is an exploded view of the portion of the casing of the alarm assembly projecting on the inner surface of the door.

The lateral panels 32 of the casing 14 are each provided with an internal lip 78 and 80 for mounting the portion of the casing projecting on the inside surface of the door 12. This latter portion is illustrated in FIG. 3. Screws are introduced through apertures 82 and 84 in the panel 90 to threadedly engage the apertures in the lips 78 and 80 by means of brackets 86 and 88 have a check on their surface so that the head of the screws when tightened through the apertures 82 and 84 will abut against the surface of the brackets 86 and 88 and be recessed inside the surface of the inner panel 90.

A lock 92 having a spindle 94 rotating with the turning of the key is mounted on the panel 90 through an aperture 96. In a somewhat similar manner as in FIG. 2, partition 98 is retained to the lock 92 by a nut 100 and spaced from the panel 90 by a spacer 102. A cam 104 is secured to the spindle 94 and rotates with it. A tumbler switch 106 is secured to two legs 108 of the lower flange 110 of the partition 98 and lever blade 112 of the switch 106 located under cam 104 is actuated by the latter.

Cover 114 is removably fixed between the legs 108 and the upper flange 116 to house the switch 106 and the cam 104. The apertures 118 and 120 are provided in the partition 98 to suport a pair of buzzers 122 and 124 which are also energized by the same battery energizing buzzers 70 and 72.

The inner panel 90 includes a mechanism for closing the apertures 82 and 84 when the panel 90 is screwed to the casing 14. Two wings 126 and 128 having respective shutter plates 130 and 132 are pivotally mounted on the panel 90 about adjacent axes with rivets or screws 127 and 129. When the wings 126 and 128 are horizontal the shutter plates 130 and 132 obstruct the apertures 84 and 82 and hide the head of the screws abutting against the brackets 86 and 88. The wings 124 and 126 are maintained in a horizontal position by a horizontal plate 134 of a sliding member 136 sitting flat on the horizontal flanges 138 and 140 of the wings. The sliding member 136 has two vertical posts 142 and 144 sliding against the panel 90 and a platform 146 for holding an upstanding finger 148. In operation, the finger 148 and the blade 112 of the switch 106 are located under and in abutment with the cam 104 and when the latter is rotated, it produces a vertical movement to the sliding member 136 and to the blade 112. In their unrestrained position without the abutment of the plate 134, the wings 124 and 126 tilt downwardly to let the plates 130 and 132 free the apertures 84 and 82. When the cam 104 is rotated, it lowers the platform 146 and the plate 134 pushes the flanges 138 and 140 downwardly at their adjacent ends. This brings the shutter plates 130 and 132 in front of the apertures 84 and 82. The corresponding position of the cam 104 is reached when the lock 92 is set in its theft detecting position as explained later with the electrical circuit. The panel 90 is also provided with an aperture 150 to support a luminous indicator 152 with the nut 154. The function of the indicator 152 is also explained later.

Figure 5:
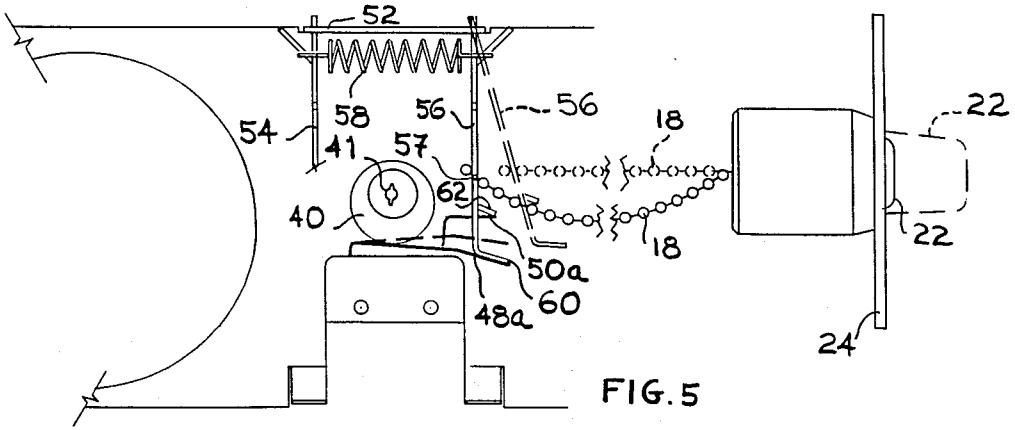
FIGS. 4 and 5 are front plan views of the spring and cam actuated mechanism mounted in the portion of the casing shown in FIG. 2.
Figure 4:
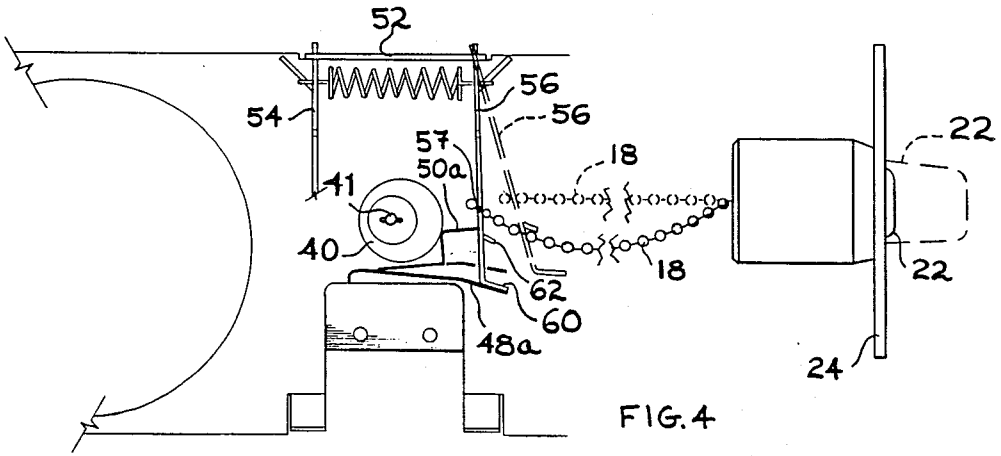

The operation of the cam 40 in combination with the switches 48 and 50 and the hinged plate 56 is illustrated in figures 4 and 5. The key 41, which actuates the lock 16 rotates the cam 40 and can depress the lever blade 50*a* when the key 41 is in a vertical position as shown in FIG. 5. In this position, the lever blade 50*a* is hooked by the lip 62 of the hinged plate 56 while the lip 60 presses down the blade 60. When the door is opened, the knob 22 extends outside the stile 24 and pulls on the flexible chain 18 retained by the plate 56 and the spring 58. In this condition, the hinged plate 56 shown in dotted lines is pulled out of engagement with the blades 48*a* and 50*a*. However, if the key 41 is in its vertical position, the cam 40 maintains the blade 50*a* down. In FIG. 4, the key is in its horizontal position and the blade 50*a* can move upwardly if it is not held down by the plate 56. The various combinations of positions of the cam 40, the blades 48*a* and 50*a* and the hinged plate 56 actuate the switches 48, 50 and 106 in the manner explained by an electrical circuits illustrated in FIG. 8.

When the key 41 is in the horizontal ON position as shown in FIG. 4, the cam 40 releases the blade 50*a* of the switch 50. In this position, if the door is opened, the knob 22 pulls on the chain 18 and the plate 56. At that time, the blade 50*a* raises and the switch 50 is made to actuate the buzzers as explained later in figure 8. When the key is in the vertical position, that is, OFF, (see FIG. 5) the cam 40 holds the blade 50*a* in its lower position to close the switch 50. When the door opens, the knob 22 pulls on the chain 18 and on the plate 56. However, the buzzers cannot operate because the cam 40 hold down the blade 50*a* in its lower position. That explains the OFF position.

All the buzzers are connected, through the switch 48, to operate each time the door is opened unless the key 41 is in the vertical position. When the knob 22 slides out of the door stile 24, the lip 60 releases the blade 48*a* which raises establish contact with the buzzers.

Figure 6:
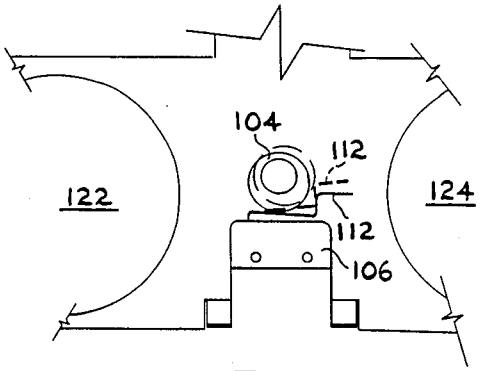
FIG. 6 is a front plan view of the cam operated mechanism mounted in the portion of the casing shown in FIG. 3.

When the lock 92 (see FIG. 3) on the internal side of the door is positioned with the corresponding key in the horizontal position (see dotted lines in FIG. 6), the blade 112 is disengaged and openes the circuit i.e. in the OFF position. In this position, the circuit is made to pass through the test light 152 (fig.3) to check the state of the battery used in the system. At the same time the sliding member 136 (FIG. 3) is moved upwardly to actuate the wings 126 and 128 to open the apertures 82 and 84. In this position, repairman can remove inner panel 90 from the outer panel 30. To facilitate this operation, a multi-prong connection 125 is mounted between the wiring in the inner and outer portion of the casing 14.

Figure 8:
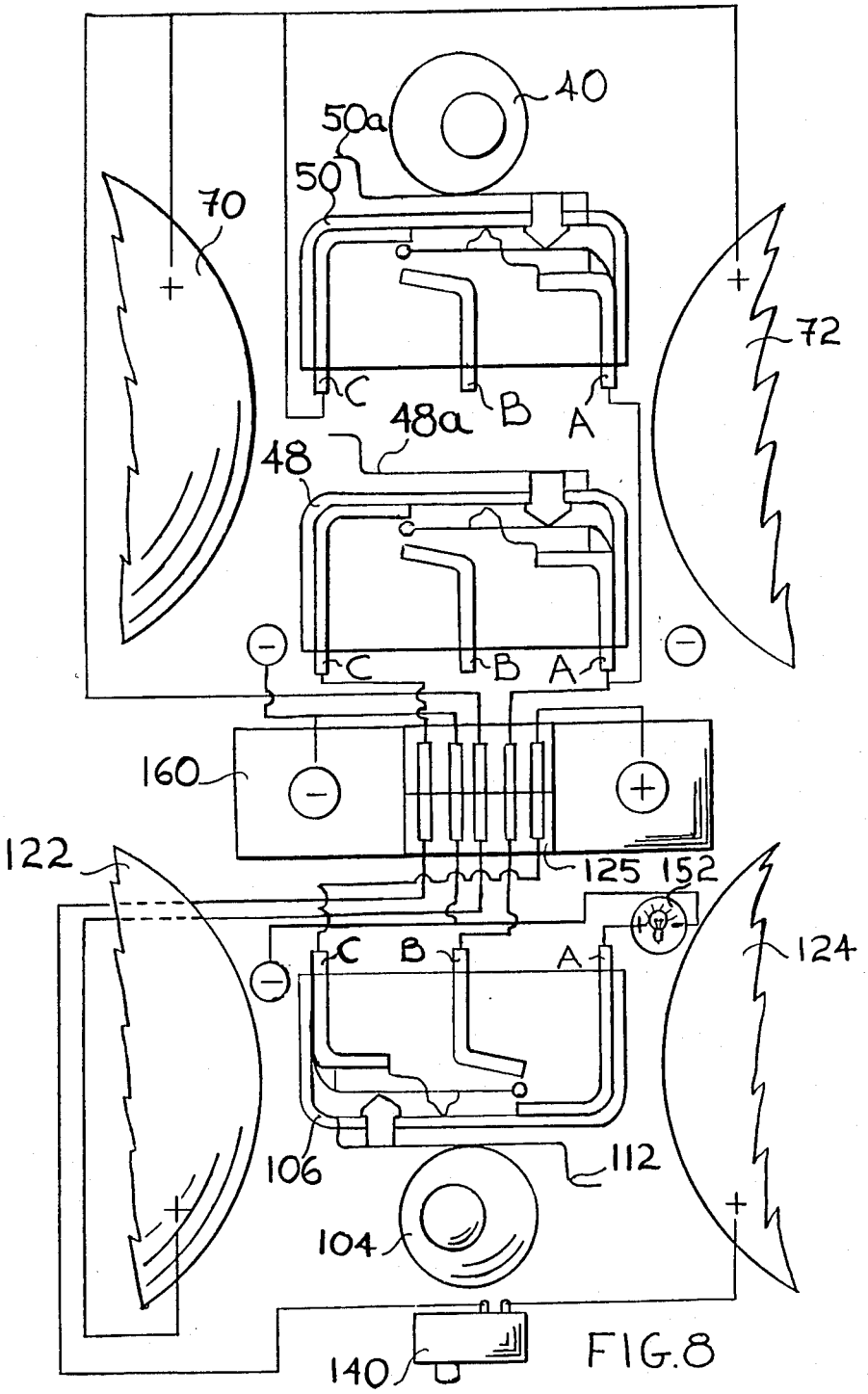

The connections between the swtiches 48, 50 and 106, the buzzers 70, 72, 122 and 124 with the battery 160 are schematically illustrated in FIG. 8. These connections allow the operations as described above. In particular, the current passing through terminal A of switch 48 is directed towards terminal C of switch 48, when the blade 48*a* is in its raised position i.e. when the door is opened. The current passing through the terminal C is connected to the buzzers 70, 72, 122 and 124. Terminal B of switch 48 is not used in the alarm system.

When the lock 16 is in the OFF position, the cam 40 applies a downward pressure on the blade 50*a* of the switch 50. The current of terminal A of switch 50 reaches temrinal C of switch 106. The current from switch 50 is directed towards terminal B which is not used for the operation of the alarm system. When the external lock 16 is in the ON position, and when the door opens, the plate 56 is pulled by the knob 22 and the cam 40 releases the blade 50*a*. The alarm system is then actuated. The current at terminal A of the switch 50 is directed towards terminal C of switch 50 and subsequently to the four buzzers 70, 72, 122 and 124.

When the lock 92 is on the OFF position, the cam 104 releases the blade 112 of switch 106. The current of terminal A of switch 106 and at the same time the indicator 152 lights up to verify the state of the battery. Simultaneously, the sliding member 136 moves upwardly and actuated the wings 126 and 128 which opens the apertures 84 and 82.

When the lock 92 is in the ON position, the cam 104 applies pressure on the blade 112 of the switch 106 to close the circuit. The current of terminal A of switch 106 is directed towards terminal B of switch 106 and at the same time to terminal A of switch 50. At the same time, the luminous indicator 152 shuts off and the sliding member 136 moves downwardly to bring the wings 126 and 128 in front of the apertures 84 and 82.

A toggle switch 140 is also foreseen in the circuit to immediately shut off the alarm system. The system can also be adapted for notifying a deaf person by providing a luminous remote signal or a combined luminous and sound signal while maintaining the basic mechanical structure described.

The system has been explained above with the use of hinged plate 56 for a door opening in one direction. The same system can be readily converted to a door opening in the other direction. Use is then made of hinged plate 54 instead of plate 56.

Although, the alarm system above-described is adapted to a variety of possible sound warnings, the scope of the basic embodiment can be limited to a single signal produced when the door opens and actuates the mechanical device responsive to the displacement of the knob 22.

I claim:

1. An alarm assembly adapted to be mounted inside a door frame, comprising:

a casing for housing a power supply, a noise producing device and an electrical circuit, said circuit operating from said power supply for actuating said noise producing device, a switch mounted in said circuit, said switch having a spring operating lever blade for actuating said switch, a hinged plate mounted in said casing and a spring for biasing said plate in the direction of said blade and adapted to deflect said blade for actuating said switch, a knob adapted to be retractedly mounted through one of the lateral faces of a door and to project outside said face, and a flexible link adapted to be mounted inside said door for connecting said knob to said plate, said knob being normally maintained in a retracted position whereby when said knob is projecting outside said face, said plate is biased in the direction of said blade to deflect the latter and actuate said switch and said noise producing device;

the said assembly further comprising:

a first key operating device having a rotatably spindle, a first cam mounted on said device and adapted to rotate with said spindle, and a second switch having a second spring operating blade for actuating said second switch, said first cam mounted adjacent said second blade for actuating the latter upon rotation of said first cam, the said second blade being located adjacent said hinged plate and adapted to inhibit its movement when the knob is in a retracted position, whereby when the door is opened, the knob projects outside said face and the hinged plate is pulled by said flexible link away from said second blade, and said second switch actuates the circuit and the noise producing device.

2. An alarm assembly as recited in claim 1 comprising a second key operating device having a second spindle, a second cam mounted on said device and adapted to rotate with said second spindle, a third switch having a third spring operating blade for actuating said third switch, said second cam mounted adjacent said third blade for actuating the latter, the said third switch being connected to said first and second switches, said second cam being mounted adjacent said third blade of said third switch for closing or opening the circuit passing through the first and second switches.

3. An alarm assembly as recited in claim 2 comprising a luminous indicator mounted on said casing and adapted to be connected to said power supply, the said third switch being mounted between said indicator and said power supply for testing the later.

4. An alarm assembly as recited in claim 2 comprising a pair of wing members pivotally mounted in said casing for blocking apertures provided on said casing, a sliding member adapted to tilt said wing members, said second cam located adjacent said sliding member whereby the rotation of said second cam is adapted to move said sliding member.

5. An alarm assembly as recited in claim 1 comprising a tightly wound metal coil spring mounted over said flexible link for protecting said link.

6. An alarm assembly as recited in claim 1 comprising a spring mounted pin fixed inside said casing and adapted to project outside said casing, a bracket mounted on said spindle located adjacent said pin and adapted to rotate with said spindle, the said bracket being shaped so as to project said pin outside said casing during part of its rotation.

* * * * *